US007522706B2

(12) United States Patent
Lu et al.

(10) Patent No.: US 7,522,706 B2
(45) Date of Patent: Apr. 21, 2009

(54) X-RAY TUBE COOLING COLLAR

(75) Inventors: Qing Kelvin Lu, Aurora, IL (US); Allan D. Kautz, Naperville, IL (US); Xiaopo Ma, Naperville, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 462 days.

(21) Appl. No.: 10/597,004

(22) PCT Filed: Jan. 5, 2005

(86) PCT No.: PCT/IB2005/050047

§ 371 (c)(1),
(2), (4) Date: Jul. 6, 2006

(87) PCT Pub. No.: WO2005/069343

PCT Pub. Date: Jul. 28, 2005

(65) Prior Publication Data

US 2008/0317210 A1 Dec. 25, 2008

Related U.S. Application Data

(60) Provisional application No. 60/536,076, filed on Jan. 13, 2004.

(51) Int. Cl.
*H01J 35/10* (2006.01)

(52) U.S. Cl. ..... 378/141; 378/130

(58) Field of Classification Search ..... 378/127, 378/130, 136, 141, 199, 200
See application file for complete search history.

(56) References Cited

U.S. PATENT DOCUMENTS 6,977,991 B1 * 12/2005 Neumeier et al. ..... 378/141

* cited by examiner

*Primary Examiner*—Jurie Yun

(57) ABSTRACT

An x-ray tube assembly (1) includes a cathode housing (30) which has a neck connected to a frame (14) of the x-ray tube assembly. An anode (10) is positioned within an evacuated chamber defined by the frame. To reduce overheating of the neck by backscattered electrons, a cooling collar (70, 70', 70") is positioned around the neck of the cathode housing. Cooling fluid enters the collar through a fluid inlet tube (72, 72', 72"). A cover member (110, 110', 110") of the collar includes a wall (118, 118', 118") which defines an aperture (126, 126', 126") sized for receiving the neck of the cathode housing. Cooling fluid flows around an interior annular flow path (152, 152') defined within the cover member and leaves the cover member through the aperture or associated notches. In this way, stagnation of the flow is minimized.

22 Claims, 7 Drawing Sheets

X-RAY TUBE COOLING COLLAR

CROSS REFERENCE TO RELATED CASES

Applicants claim the benefit of Provisional Application Ser. No. 60/536,076, filed Jan. 13, 2004.

The present application relates to the x-ray tube arts. The invention finds particular application in conjunction with the cooling of a cathode assembly and will be described with particular reference thereto. It will be appreciated, however, that the invention also finds application in the transfer of heat to or from other cylindrical components.

Typically, an x-ray tube includes an evacuated envelope or frame made of metal, ceramic, or glass, which is supported within an x-ray tube housing. The x-ray tube housing and the frame define a cooling oil passage therebetween. Electrical connections are provided through the housing to the envelope. The envelope and the x-ray tube housing each include an x-ray transmissive window aligned with one another such that x-rays produced within the envelope may be directed to a patient or other subject under examination.

In order to produce x-rays, the envelope houses a cathode assembly and an anode assembly. The cathode assembly includes a cathode filament through which a heating current is passed. This current heats the filament sufficiently that a cloud of electrons is emitted, i.e. thermionic emission occurs. A high potential, on the order of 100-200 kV, is applied between the cathode assembly and the anode assembly.

This potential accelerates the electrons from the cathode assembly to the anode assembly through the evacuated region in the interior of the evacuated envelope. The electrons are focused onto a small area or focal spot on a target of anode assembly. The electron beam strikes the target with sufficient energy that x-rays are generated, along with large amounts of heat. A portion of the x-rays generated pass through the x-ray transmissive windows of the envelope and x-ray tube housing, toward the patient or subject under examination.

A deflecting cathode structure is sometimes used to move or wobble the electron beam, hence the focal spot, in a direction intersecting the circumferential direction of the anode rotation. An electromagnetic deflecting coil surrounds a neck of the housing where the cathode filament joins the envelope or insert frame. When an electric current is passed through the coil, an electromagnetic field is generated, deflecting the electron beam. Periodic shifting of the focal spot is used to reduce target loading and improve CT imaging resolution. However, a portion of the electrons are back scattered and strike the cathode housing. The area of the cathode neck joint, where the cathode housing is connected to the main body of the insert frame, is particularly prone to localized heating. Overheating of the cathode neck joint can cause joint failure and damage the hermetic seal of the x-ray tube.

In order to distribute the thermal loading created during the production of x-rays, a cooling fluid, such as oil, is circulated through the x-ray tube housing over the frame and cathode housing to aid in cooling components of the x-ray tube. Very high localized heating by the backscattered electrons also tends to deteriorate the quality of the cooling liquid, which eventually can lead to tube failure.

To reduce the localized heating adjacent the cathode housing neck, it is desirable for additional cooling liquid to be applied directly to the cathode neck area. Due to the high flow resistance of components surrounding the cathode neck, however, such as the filament deflection coil, the cooling fluid has difficulty in reaching the neck region.

One method to overcome this has been to place a collar around the cathode neck joint with an inlet and an outlet. Cooling fluid is forced through the inlet and is divided into two subflows, each of the subflows passing 180° around one side of the neck joint. The subflows merge and exit at the outlet at the opposite side. As a result, the area closest to the inlet receives the most efficient cooling as the fluid is steadily heated toward the outlet. Moreover, a flow stagnation zone occurs adjacent the neck where the two subflows merge, leading to poor localized cooling of the joint in that region. Additionally, the bottom part of the cathode housing is poorly cooled because of the lack of flow in that region. As a result, uneven cooling of the cathode neck joint tends to occur.

The present invention provides a new and improved method and apparatus which overcome the above-referenced problems and others.

In accordance with one aspect of the present invention, a cooling device for an associated x-ray tube is provided. The cooling device includes a fluid inlet which receives a supply of cooling fluid from an associated source. A hollow cover member is in fluid communication with the inlet. The cover member includes a wall which defines an aperture sized for receiving a portion of the associated x-ray tube therethrough. The cover member defines an interior annular flow path for cooling fluid to circulate around the portion of the associated x-ray tube. The aperture of the cover member is configured for providing at least one fluid outlet through which cooling fluid exits the cover member at a plurality of locations around the portion of the associated x-ray tube.

In accordance with another aspect of the present invention, an x-ray tube assembly is provided which includes the cooling device described above.

In accordance with another aspect of the present invention, a method of cooling a neck of an x-ray tube is provided. The method includes mounting the cooling device described above around the neck.

One advantage of at least one embodiment of the present invention is that overheating of a cathode neck joint is alleviated.

Another advantage of at least one embodiment of the present invention is that it extends x-ray tube life.

Another advantage resides in reducing premature tube failure.

Still further advantages of the present invention will become apparent to those of ordinary skill in the art upon reading and understanding the following detailed description of the preferred embodiments.

The invention may take form in various components and arrangements of components, and in various steps and arrangements of steps. The drawings are only for purposes of illustrating a preferred embodiment and are not to be construed as limiting the invention.

Figure 1:
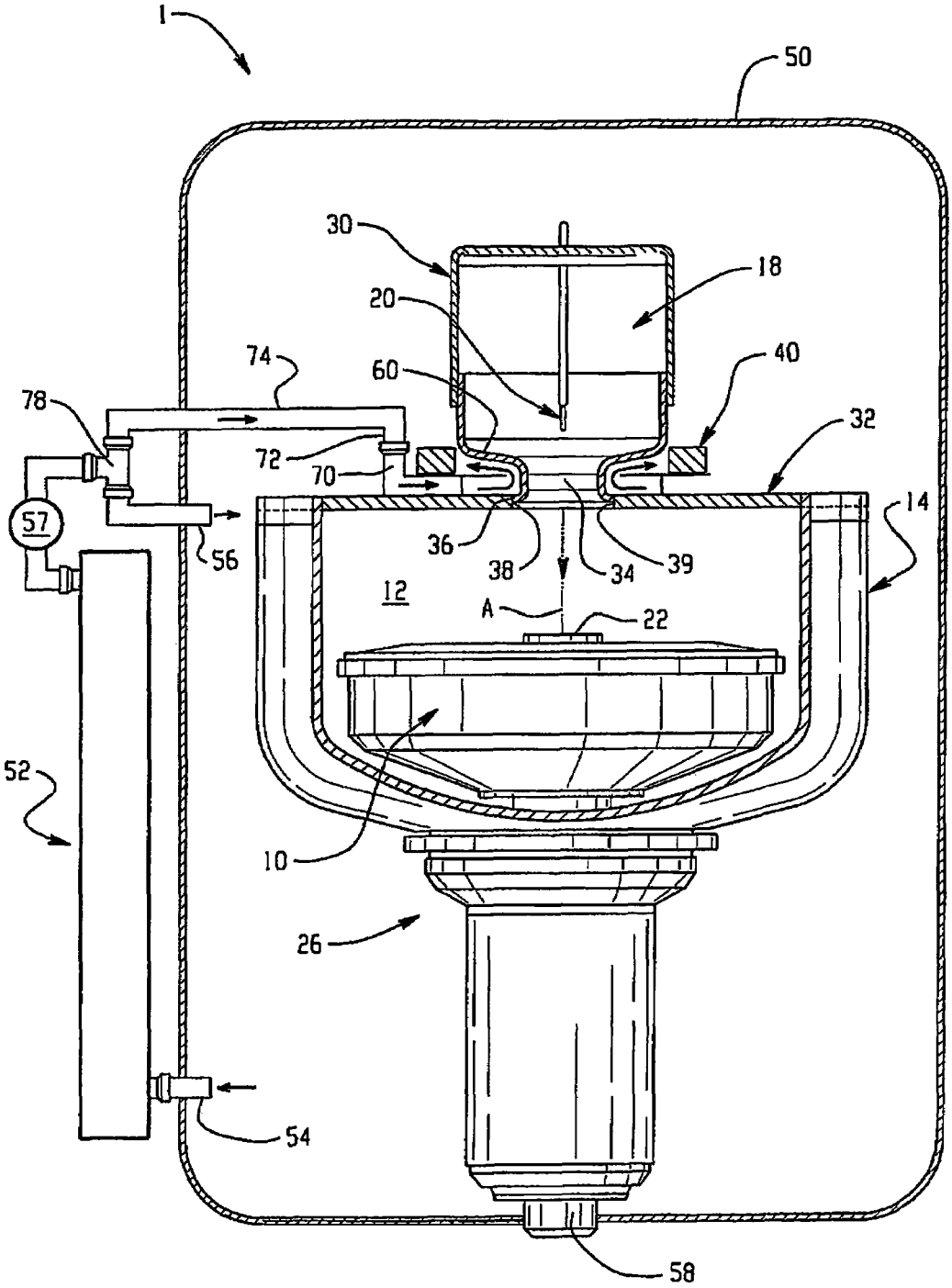
FIG. 1 is a diagrammatic illustration, partially cut away, of an x-ray tube assembly and a cooling system according to one embodiment of the present invention.

With reference to FIG. 1, a rotating anode x-ray tube assembly 1 of the type used in medical diagnostic systems, such as computed tomography (CT) scanners, provides a beam of x-ray radiation. The assembly 1 includes an anode 10 which is rotatably mounted in an evacuated chamber 12, defined by an envelope or insert frame 14, typically formed from glass, ceramic, and/or metal. A cathode assembly 18 supplies and focuses an electron beam A. The cathode assembly includes a source of electrons 20, such as a thermionic filament. The filament 20 is biased, relative to the anode 10, such that electrons are accelerated toward the anode and strike a target area 22 of the anode. A portion of the electrons striking the target area 22 is converted to x-rays, which are emitted from the x-ray tube through a window 24 in the envelope (in the cut away section toward the viewer in FIG. 1). The X-radiation is used for diagnostic imaging, therapy treatment, and the like. The insert frame 14, cathode assembly 18, and anode 10 together comprise an x-ray tube 26 of the assembly 1.

Figure 2:
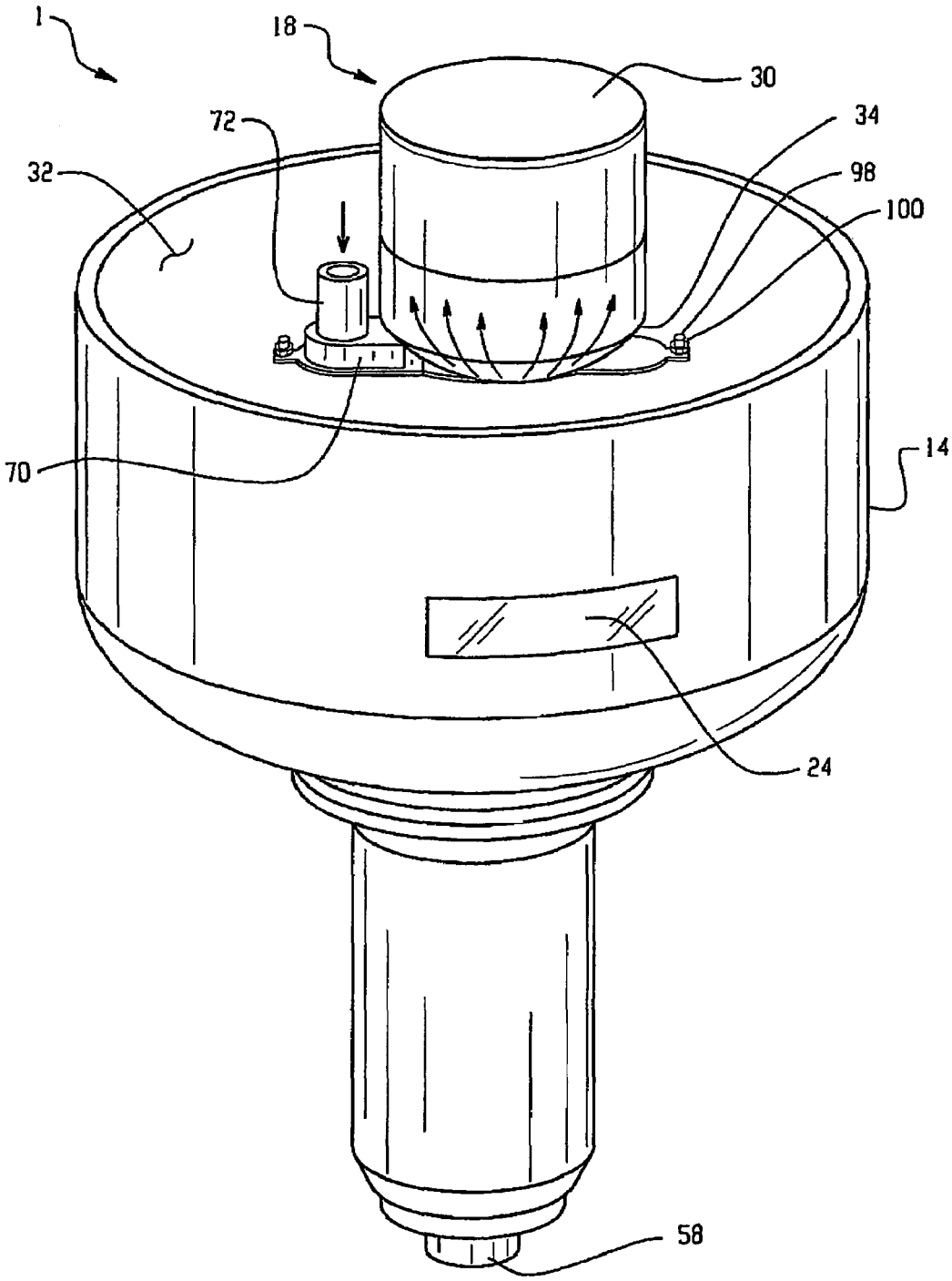
FIG. 2 is a perspective view of the x-ray tube and cooling collar of FIG. 1.

With reference also to FIG. 2, the cathode assembly 18 includes a cathode housing or cup 30, which houses the filament 20. The housing 30 is mounted to a cathode plate 32 which forms an end wall of the insert frame 14. The cathode housing 30 narrows, adjacent to the cathode plate, to define an annular region of reduced width or neck 34. A distal end 36 of the neck 34 is welded or otherwise mounted and sealed to the cathode plate 32 at a neck joint 38, around an opening 39 in the plate, such that the neck extends generally perpendicular to the plate.

The cathode housing 30 serves to focus the electrons emitted from the cathode filament 20 to a focal spot on the anode target area 22. In one embodiment, the cathode housing 20 is at an electrical potential of about −75,000 volts with respect to ground, and the anode 10 is at an electrical potential of about +75,000 volts with respect to ground, the potential difference between the two components thus being about 150,000 volts.

With continued reference to FIG. 1, a C-shaped electromagnetic deflecting coil 40 partially surrounds the cathode housing 30 in the region of the neck 34. By selectively applying a current to the coil 40, an electromagnetic field is created which deflects the beam of electrons, allowing the focal spot to be shifted, periodically, on the anode target area 22, thereby reducing the focal spot temperature.

An x-ray tube housing 50, filled with a heat transfer and electrically insulating fluid, such as oil, surrounds the envelope 14. A cooling system 52 receives heated cooling liquid from the housing through an outlet line 54 and returns cooled cooling liquid via a return line 56. The lines 54, 56 may be in the form of flexible hoses, metal tubes, or the like. The cooling system 52 includes a pump 57 and a heat exchanger (not shown). When returned to the housing 50, the cooled cooling liquid flows past the window 24, and around a bearing assembly 58 for the anode, the cathode assembly 18, and other heat-dissipating components of the x-ray tube 26.

A portion of the electrons striking the anode 10 is not converted to x-rays, but rather is backscattered, towards the cathode housing 30. The backscattered electrons strike the cathode housing 30, primarily in the area of the neck 34, which becomes heated thereby. Heat also flows from the neck 34 into a lower end 60 of the cathode housing 30, which also tends to become heated.

A cooling device 70 in the form of a cooling collar surrounds the neck 34 of the cathode housing 30. In one embodiment, as shown in FIG. 1, the cooling collar 70 is located intermediate the plate 32 and the deflecting coil 40. The cooling collar 70 includes an inlet tube 72, through which a cooling fluid, such as the cooling liquid used to cool the housing 50 is fed to the collar. The cooling liquid inlet tube 72 is fluidly connected with the cooling system 52 (or with a separate cooling system) which supplies cooled cooling liquid to the inlet tube 72 via a cooling collar fluid line 74. The pump 57 ensures that the collar 70 receives a continuous flow of cooling liquid when the x-ray tube 26 is operating. Optionally, a T-connector 78 splits the flow of cooling liquid into two flow paths, along lines 56 and 74 respectively, such that some of the cooling liquid flows directly to the housing 50, without passing through the collar. Alternatively, the line 54 is omitted and all of the cooling liquid is directed first to the cooling collar 70 and from there enter the main cooling housing 50 of the x-ray tube, or vice versa.

The cooling collar 70 may be formed from metal, ceramic, heat resistant plastic, or the like and may be removably attached, welded, or otherwise fixed to the base plate 32.

Figure 3:
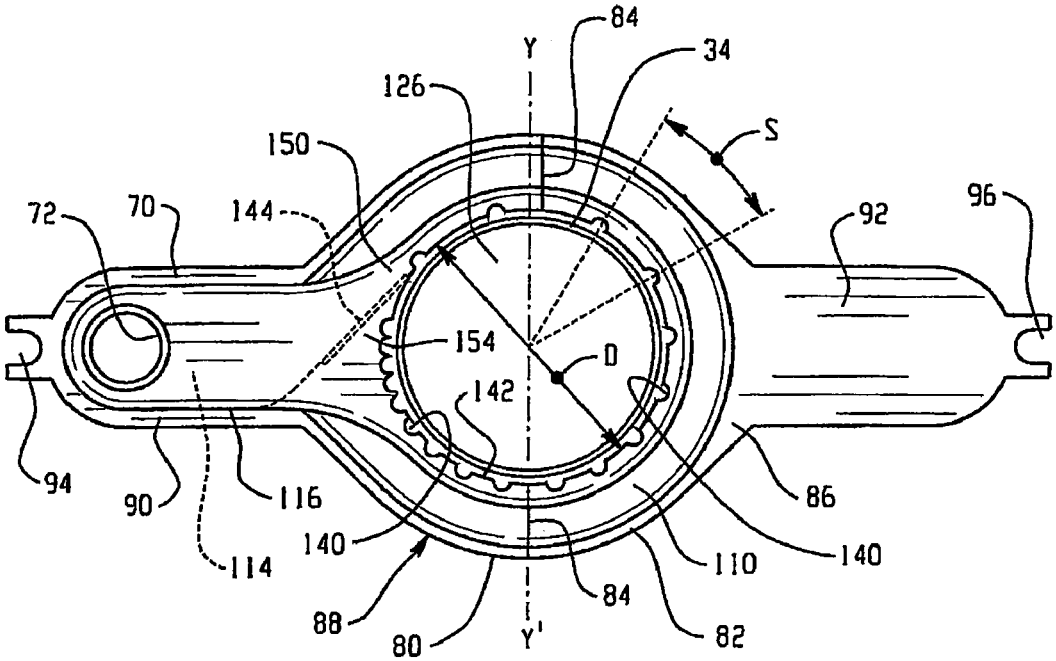
FIG. 3 is an enlarged top plan view of a first embodiment of the cooling collar of FIG. 2.

With reference now to FIG. 3, the cooling collar 70 includes first and second side portions 80, 82, which are joined or butted together, during assembly, around the neck at a seam 84. The assembled cooling collar 70 includes a generally planar base plate 86 configured for attachment to the cathode plate 32. Specifically, the base plate 86 includes a generally annular central region 88 from which first and second mounting brackets 90, 92 extend in opposite directions. The central region 88 is positioned to contact the base plate 32 with its lower surface. The mounting brackets 90, 92 define semicircular cutouts 94, 96, respectively at distal ends thereof. The mounting brackets 90, 92 are mounted to suitably positioned threaded studs 98, which are welded to the cathode plate 32 and held in place by threaded nuts 100 (FIG. 2).

The seam 84 need not be welded or otherwise form a fluid tight joint between the two portions 80, 82, since a small amount of leakage through the seam does not impact the effectiveness of the cooling collar 70. In general, the coil 40, in cooperation with the studs 98 and nuts 100, is sufficient to keep the two portions 80, 82 in sufficient contact at the seam 84 to reduce leakage through the seam to a minimum.

Figure 4:
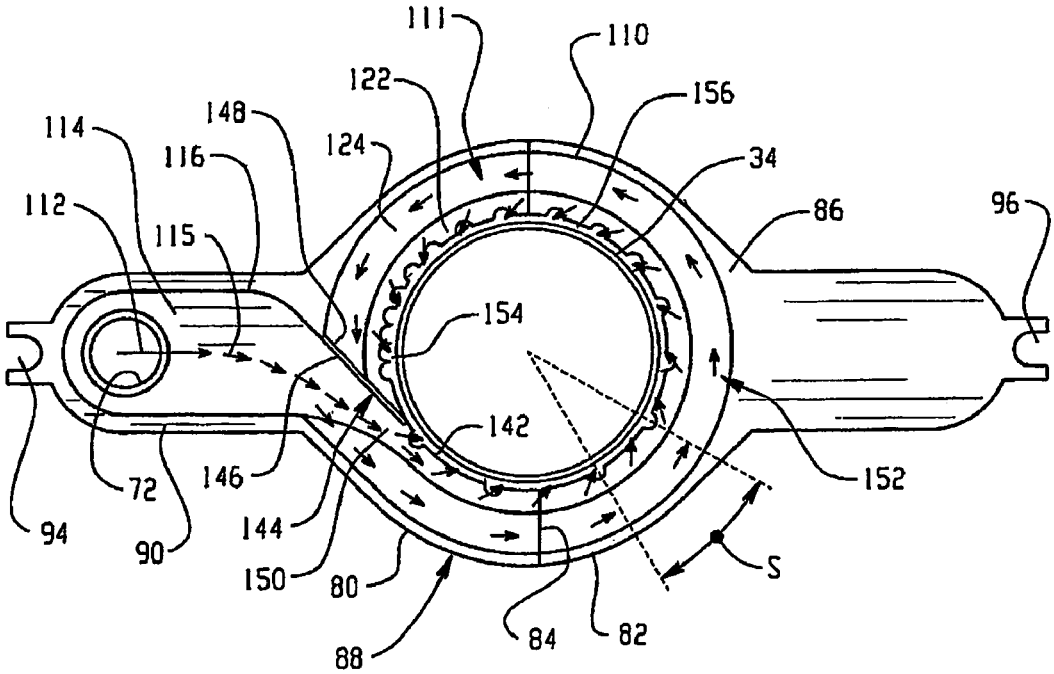
FIG. 4, is a bottom plan view of the cooling collar of FIG. 3.
Figure 5:
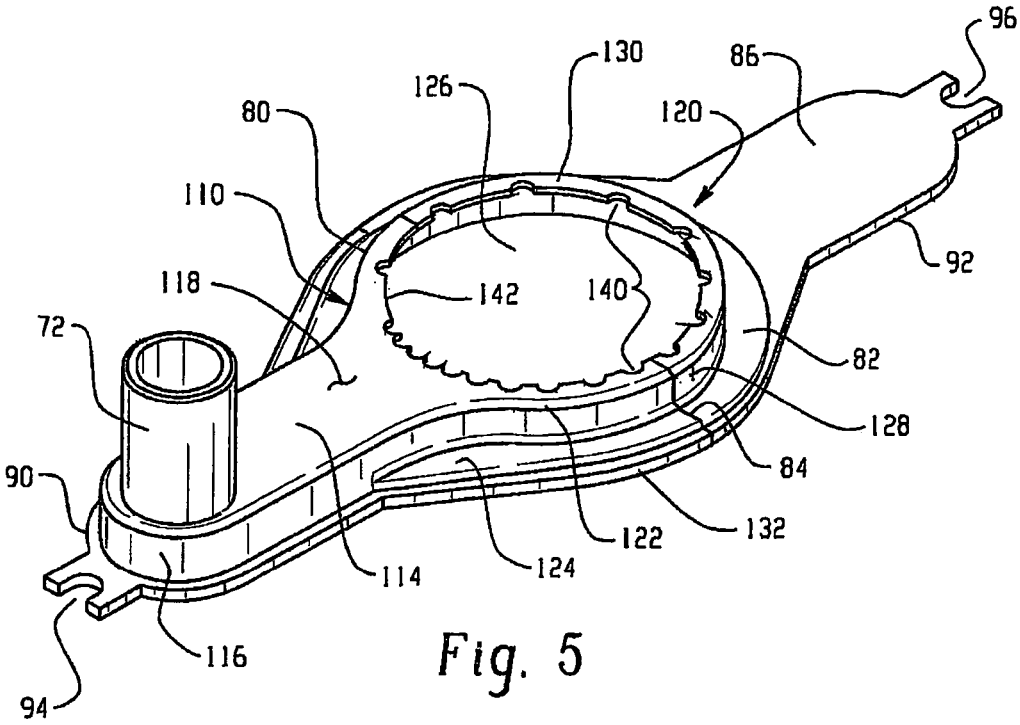
FIG. 5 is a top perspective view of the cooling collar of FIG. 3.

As shown in FIGS. 4 and 5, a hollow cover member 110 is connected with the base plate 86 and extends away from the plate to define an annular interior space 111 for cooling liquid to circulate. The cover member 110 defines, at least in part, an interior fluid flow path 112 (indicated by arrows in FIG. 4), along which the cooling liquid flows. The adjacent exposed portions of the neck 34 and plate 32 also partly define the flow path 112. The cover member 110 includes an elongate inlet portion 114, aligned with one of the mounting brackets 90, which is connected with the inlet tube 72 at a distal end thereof. The inlet portion 114, in cooperation with the exposed portion of the plate 32 beneath, defines a first portion 115 of the fluid flow path 112.

As best shown in FIG. 5, the inlet portion 114 has a raised vertical sidewall 116 covered by a top member or wall 118 at an upper end thereof. The terms "upper" and "lower" and the like are used with respect to the orientation of the x-ray tube 26 as illustrated in FIG. 1. It will be appreciated that in use, the x-ray tube may have a different orientation.

The inlet portion 114 is connected with an annular central portion 120 of the cover member 110. The central portion 120 is stepped to create a support surface for the deflecting magnet 40. In particular, upper and lower generally annular concentric raised portions or steps 122, 124 are defined, the lower step 124 being of larger interior diameter to support the magnet and the upper step 122 having another diameter to match the magnet inner diameter. The upper step 122 has a central aperture 126 which is preferably concentric with the two steps and sized to match the neck 34. The upper annular step 122 has a vertical sidewall 128 which extends around the aperture 126 from the sidewall 116 of the inlet portion 114, but is of reduced height, as compared with sidewall 116, due to the lower step 124. The top member 118 of the inlet portion 114 extends across the sidewall 128 of the upper step 122 and includes an annular portion 130 which defines the central aperture 126 therein.

The lower step 124 includes a vertical sidewall 132 and a generally annular shelf 134 (FIG. 8) which extends between the sidewall 132 and the sidewall 128 of the upper step 122. In the illustrated embodiment, the top member 118, shelf 134, and base plate 86 are all parallel with one another and with the plate 32, and are perpendicular to the sidewalls 116, 128, 132, although it is also contemplated that inwardly or outwardly curved or sloped sidewalls 116, 128, 132 may be employed and/or that the shelf 134 and top member 118 may be curved or sloped, rather than flat. Additionally, while two steps 122, 124 are shown, it is contemplated that these may be combined into a single step, or that more than two steps may be provided.

With reference once more to FIG. 3, the aperture 126 has an interior diameter D which is close to or slightly larger than that of the neck 34 to accommodate the neck snugly therein. Angularly spaced notches 140 are formed around a perimeter 142 of the aperture 126 and serve as flow outlets for the cooling liquid. The notches 140 are shown as semicircular cut outs which extend radially outward from the aperture 126, although notches of other shapes are contemplated. As shown in FIG. 4, the cooling liquid flows around the neck 34 in the upper step 122 and exits the cooling collar through the notches 140.

The notches 140 have a much smaller diameter than the aperture 126. For example, the notches may, have a diameter or width of about 0.05-0.2 cm, e.g., about 0.1 cm, and the aperture a diameter D of about 2-3 cm, depending on the size of the cathode neck 34. The cathode neck may have a diameter which is 0.01-0.3 cm less than the diameter D. Thus, a ratio of the diameter of the notches 140 to the diameter of the aperture 126 may be from about 1:60 to about 1:10. There may be from about 8 to about 30 notches 140 spaced around the perimeter 142 of the aperture 126, preferably, about 15 to 20. Preferably, at least some of the notches 140 are located in each of four separate quadrants of the aperture 126, irrespective of the selected angular positions of the four quadrants.

The majority of, and preferably substantially all of the cooling fluid which enters the fluid flow path 112 exits the cooling device 70 through the aperture 126 and its associated notches 140. The cooling liquid exits the notches 140 as jets, aiding the mixing of cooling liquid in the region of the neck 34 and thus improving heat transfer away from the neck. Although small amounts of cooling liquid may leak from around the base plate 32 or through the seam 84, this preferably accounts for less than about 20% of the total fluid flowing in the flow path 112, generally less than about 10%.

Figure 6:
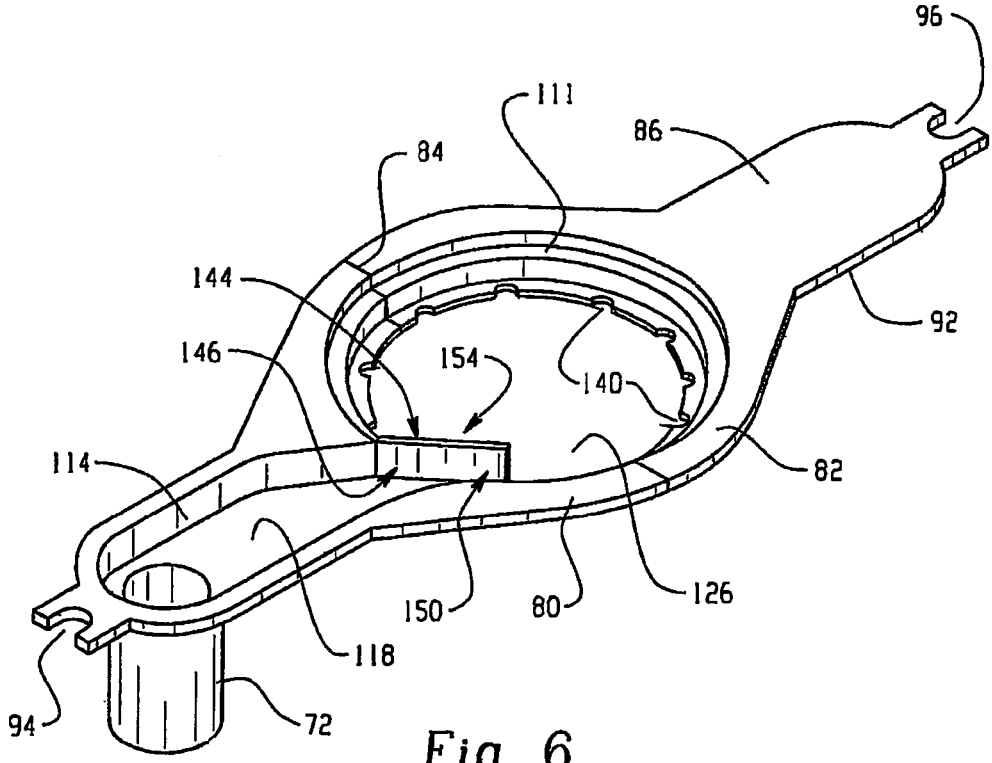
FIG. 6 is a bottom perspective view of the cooling collar of FIG. 3.
Figure 7:
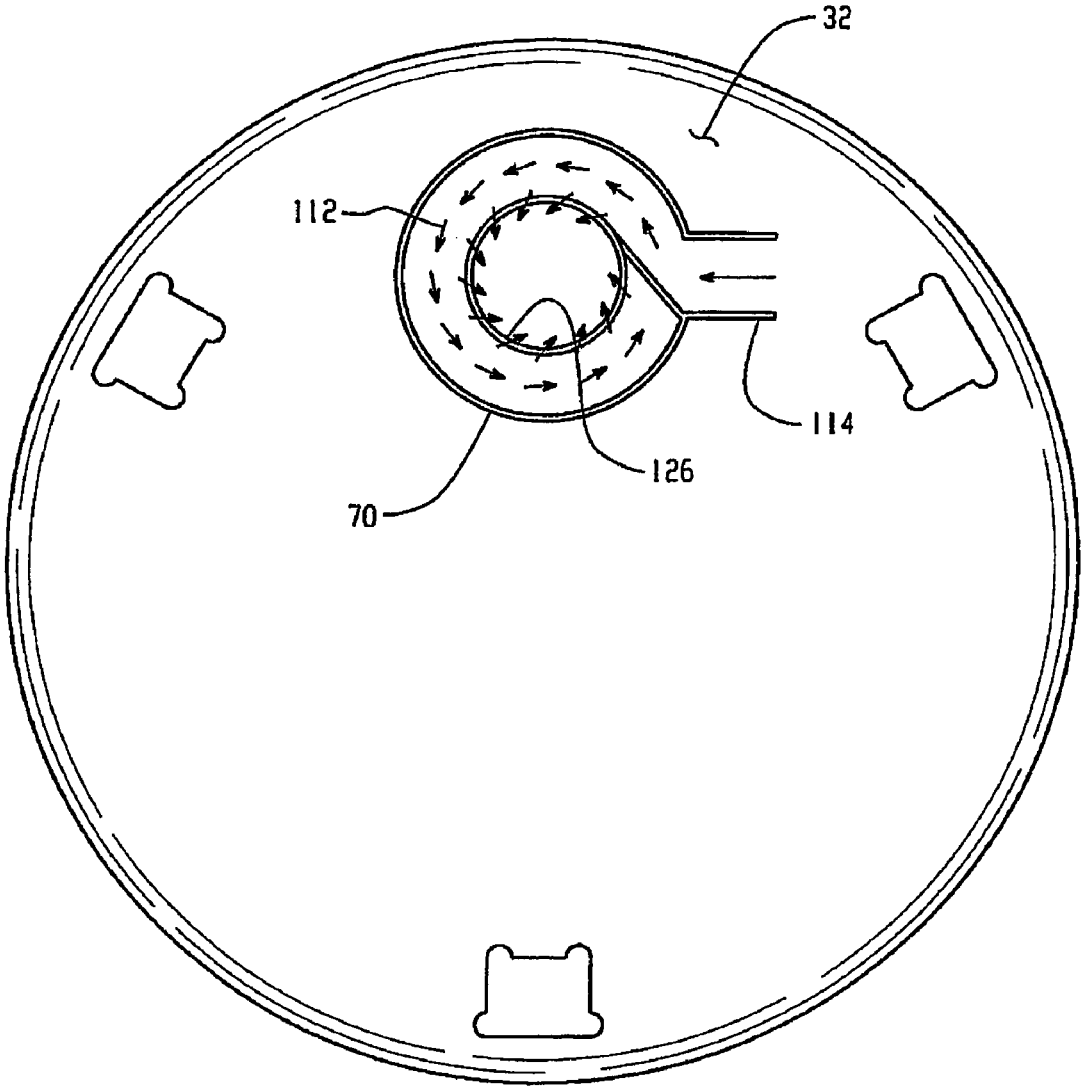
FIG. 7 is a top diagrammatic view of the x-ray tube frame top piece and the cooling collar of FIG. 3, showing the direction of fluid flow.

As shown in FIGS. 4, 6, and 7, baffle 144 in the form of a generally vertical wall is mounted across the interior of the inlet portion 114. The baffle 144, which in the illustrated embodiment is tangential with the circumference of the neck 34, ensures a generally unidirectional circular flow of cooling fluid around the neck 34, as shown by the arrows in FIG. 4. It will be appreciated that it is the component of the flow that is in the horizontal plane (parallel with the plate) which follows this circular path, and that a vertical component of the flow causes the liquid to move in an upward direction, toward the notches 140. The illustrated horizontal flow component is anticlockwise, although it will be appreciated that in an alternative embodiment, with the baffle oriented at 180° to its illustrated orientation, a clockwise flow is created. A tangential orientation of the baffle 144 reduces flow resistance, although other orientations are also contemplated.

The baffle 144 extends in both the upper and lower steps 122, 124, contacting or closely adjacent to the plate 32 at its lower end and perpendicular to the plate. The baffle is attached to the top member 118 at its upper end, joined to the sidewall 116 at its inlet end, and is closely spaced from, or touches the neck 34 at its outlet end. This ensures that substantially all cooling liquid flows in the same generally circular direction. A small amount of cooling liquid may leak out between the baffle 144 and the plate 32 or neck 34 but this does not significantly affect the cooling properties and the circular flow.

As shown in FIG. 4, the baffle 144 defines first and second opposed vertical side surfaces 146, 148. The first vertical surface 146 defines, in part, an inlet end 150 of an annular portion 152 of the fluid flow path 112 and the second surface 148 defines a terminal end 154 of the annular portion 152 of the fluid flow path. Thus, cooling liquid flows around the neck 34 and the adjacent neck joint 38 in substantially a full circle (i.e., at least about 80% of a full circle, more preferably, at least 95% of a full circle), contacting side surfaces 146, 148 of the baffle 144 at the beginning and at the end of the annular portion 152 of the fluid flow path.

Not all of the cooling fluid completes the annular portion 152 of the fluid flow path, however. As the cooling liquid flows around the cathode housing neck 34, a portion of the cooling liquid begins to exit at the top 118 of the collar 70, between the collar and the neck. A significant portion of the cooling liquid exits through the notches 140, although some fluid may also leak through an annular gap 156, where present, between the neck 34 and the collar aperture 126. As shown by the flow arrows in FIG. 4, the cooling liquid exits the collar at a plurality of angularly spaced locations around the full circumference of the neck 34. Where the collar fits the neck snugly, the locations are essentially discrete regions, defined by the notches 140. Where there is a gap 156 between the collar 70 and the neck, the locations are essentially continuous, but with somewhat higher fluid flows at the notches 140. The escaping liquid from the collar impinges on the lower portion 60 of the cathode housing 30, as shown in FIG. 1, thus cooling both the neck and the portions of the cathode housing which have a tendency to become overheated.

The annular, generally unidirectional flow of the cooling fluid in the flow path portion 152 ensures that there is no stagnation zone in the flow which typically occurs when two fluid flow paths are used, one on each side of the neck. As a result, localized overheating of the neck 34 is reduced.

As the cooling liquid flows out of the notches 140, there is a pressure drop in the remaining cooling liquid in the collar, i.e., the cooling liquid pressure tends to decrease from the inlet end 150 to the terminal end 154 of the flow path portion 152, which defines the end of the flow path 112. To maintain a relatively uniform outlet flow between the collar 70 and the neck 34 around the full circumference of the neck, an angular spacing s between notches gradually decreases or the notch size increases toward the terminal end 154 of the flow path 112. The spacing s is selected to compensate for pressure losses along the direction of flow. Thus, for example, as seen in FIG. 3, the notches 140 are spaced about 30° apart near the inlet end 150, but toward the terminal end 154, the notches become steadily closer together until they are essentially contiguous.

Rather than discharging all of the cooling liquid at one side of the cathode neck 34, the cooling fluid is gradually released from the top 118 of the cooling collar 70 around the entire perimeter of the neck 34. This eliminates the flow stagnation zone which tends to occur when the fluid is all (or primarily all) released from a single side outlet in line with the inlet.

While in the illustrated embodiment, a generally uniform outlet flow is achieved by increasing the frequency of the notches, alternatively, or additionally, the notches may increase in size toward the terminal end 154.

By performing theoretical calculations (e.g., a computer simulation) on expected neck or collar temperatures, cooling fluid flow velocities, or cooling fluid pressures under anticipated flow conditions, or by conducting actual measurements during operation of the x-ray tube 26, the optimum spacing s and/or size of the notches 140 can be selected so as to maintain an even flow velocity and/or reduce variations in the neck temperature around the circumference.

Figure 8:
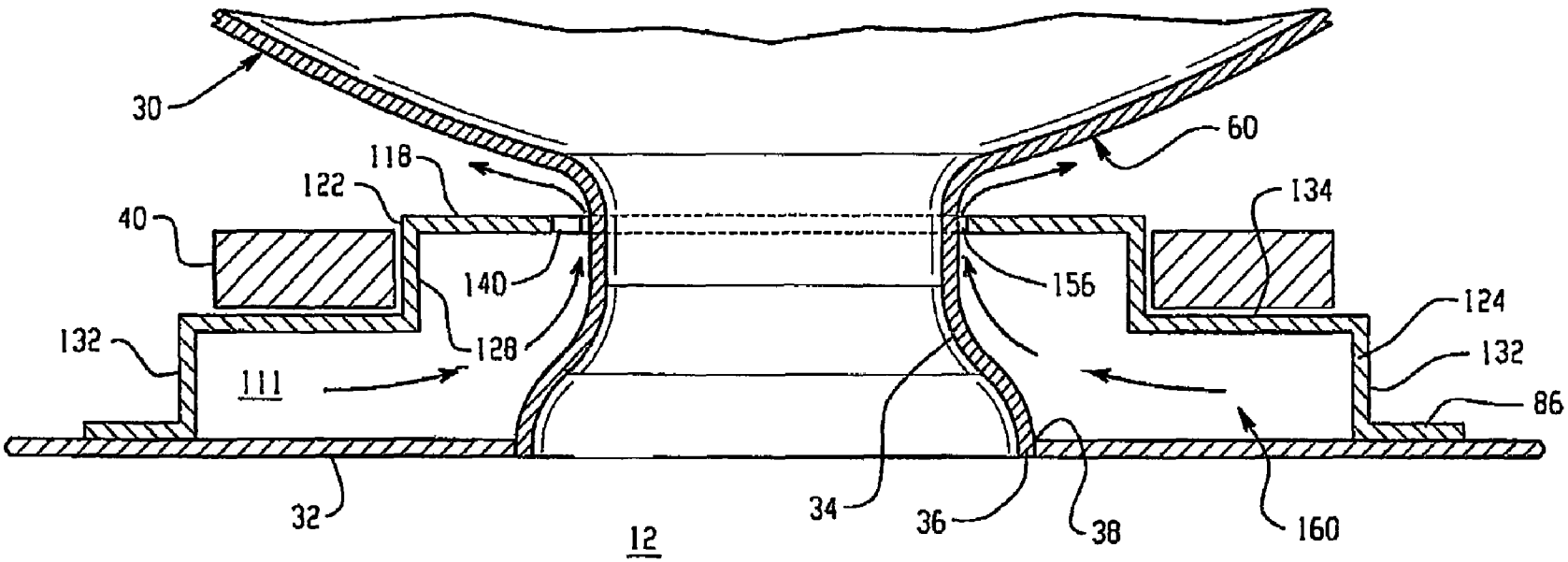
FIG. 8 is an enlarged side sectional view through Y-Y of FIG. 3 of the cooling collar mounted on the top of the x-ray tube surrounding the cathode housing neck.

As shown in FIG. 4, the cooling liquid flows both around the upper step 122 and also around the lower step 124. As illustrated in FIG. 8, the collar defines a lower open end 160 having the same internal diameter as the lower step 124. The cooling fluid flowing in the lower step 124 thus contacts both a lower portion of the neck 34 and the plate 32 in the region of the neck joint 38. As cooling liquid exits from the upper step 122, some of the cooling fluid in the lower step 124 moves upwardly into the upper step, thus carrying away heat from the neck joint 38. The steps 122, 124 are sized to permit the deflector coil 40 to be seated on the shelf 134 of the lower step 124.

Although described in terms of two steps, it is also contemplated that the shelf 134 may be contiguous with the top member 118, for example, where the distance between the collar and the lower portion 60 of the cathode housing is sufficient to permit the coil 40 to be seated therebetween. Alternatively, the coil may be located elsewhere in the x-ray tube housing, or alternatively, eliminated if focal spot adjustment is not required.

In another embodiment (not shown), the base plate 86 extends beneath one or both of the steps 122, 124, reducing the size of the opening 160 to one closer to the diameter of the neck.

Figure 9:
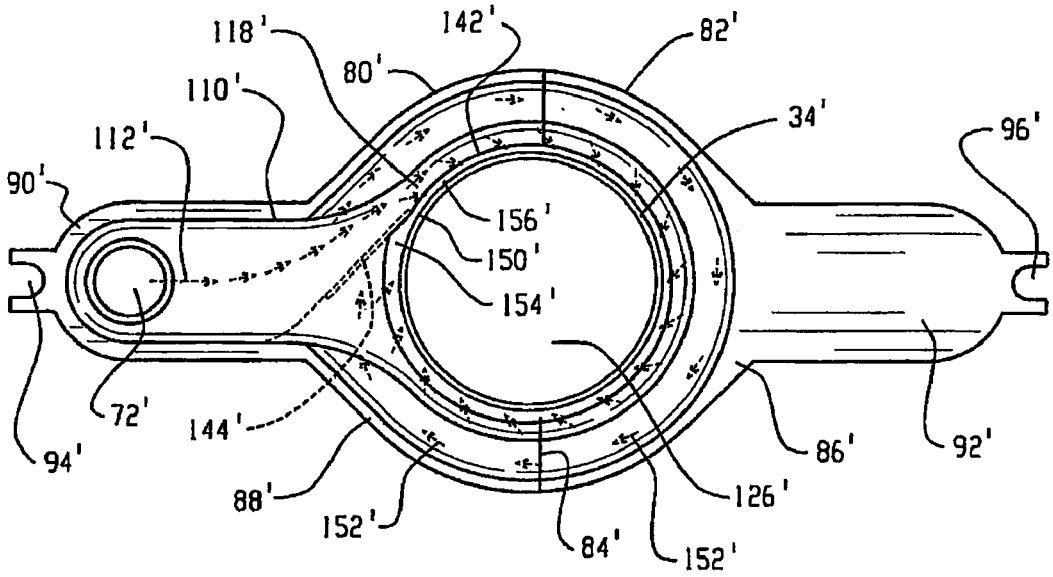
FIG. 9 is a top plan view of a cooling collar for the x-ray tube of FIG. 1 according to a second embodiment of the present invention.

With reference-now to FIG. 9, another embodiment of a cooling collar 70' is shown, where similar elements are numbered with a primed suffix (') and new elements are accorded new numerals. The cooling collar 70' is similar to cooling collar 70, except as otherwise noted. As with cooling collar 70, cooling liquid enters the cooling collar 70' via an inlet tube 72' and is directed by a baffle 144' in an annular flow path 152' around the neck 34 of the cathode housing. However, in this embodiment, the aperture 126' is not equally spaced from the neck 34 around its perimeter 142', but has a gap 156' which increases in width from the inlet end 150' to the outlet end 154' of the flow path 152'. The aperture 126' thus has a spiral shape, rather than being circular. The width of the gap 156' is selected to at least partially compensate for the pressure drop in the cooling fluid along the flow path portion. In this way, variations in temperature around the neck are minimized and/or outlet flow velocities around the neck are relatively uniform.

Figure 10:
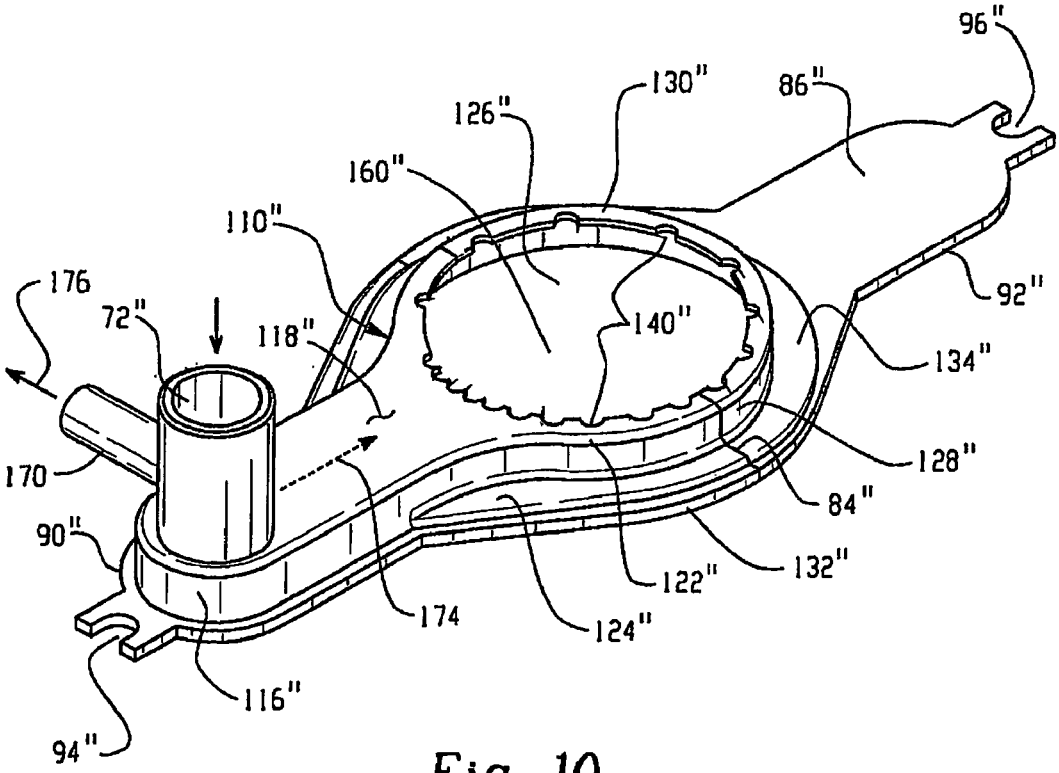
FIG. 10 is a top perspective view of a cooling collar for an x-ray tube according to a third embodiment of the present invention.

In the embodiment of FIG. 9, there are no discrete notches and the cooling fluid thus exits generally uniformly around the circumference of the neck 34. However, in an alternative embodiment (not shown), notches similar to notches 140 are provided around the aperture 126'. With reference now to FIG. 10, another embodiment of a cooling collar 70" is shown, where similar elements are numbered with a primed suffix (") and new elements are accorded new numerals. The cooling collar 70" is similar to cooling collar 70, except as otherwise noted. In this embodiment, the collar 70" provides a means for supplying a cooling liquid flow to the housing 50. Specifically, an outlet tube 170 extends from the cooling collar elongate inlet portion 114", through which a portion of the cooling liquid exits the collar 70". Thus, the cooling liquid entering through the inlet tube 72" is split into two subflows, a first subflow 174 which passes along the inlet portion 114" to the annular portion 152'" of the flow path 112, and a second subflow 176 which passes out of the cooling collar through outlet 170, prior to reaching the annular portion 152" of the flow path 112". The second subflow 176 of the cooling liquid passes directly to the housing 50 and flows past other portions of the x-ray tube 26, such as the window 24 and anode bearings 58 to cool these components. The first subflow 174 of the fluid flow combines with the second subflow 176 when it exits through the top 118" of the collar 70".

The outlet tube 170 has an internal diameter which is selected so as to maintain an adequate supply of cooling liquid to the collar 70", as well as to the housing 50. For example, the internal diameter of the inlet tube 72" is greater than the internal diameter of the outlet tube 170. In one embodiment, a ratio of the internal diameter of the inlet tube to the internal diameter of the outlet tube is from about 2:1 to about 2:1.5. For example, the diameter of the inlet tube may be about 1.0 cm and the diameter of the outlet tube may be about 0.64 cm. In one embodiment, a ratio of the fluid flow rate of subflow 174 directed through the inlet portion 114" to a fluid flow rate of subflow 176 exiting through the outlet tube 170 is in the range of from about 1:3 to about 1:1.5. For example, the fluid flow in subflow 174 may be about 1.4 grams/minute, while the fluid flow in subflow 176 may be about 2.6 grams/minute.

This embodiment has the advantage that fresh cooling fluid flows over the window 24 of the x-ray tube 26, providing a higher level of cooling than if it is cooled with cooling fluid which has all passed through the collar and around the neck of the cathode housing.

It will be appreciated that in another alternative embodiment a cooling collar similar to collar 70' may be formed with an outlet similar to outlet 170.

In yet another embodiment (not shown), the tendency for a reduction in pressure to occur as cooling liquid exits the cover member is at least partly counterbalanced by a steady decrease in width of the annular portion of the cover member from the inlet end 150 to the terminal end 154 of the flow path 112. This helps to minimize the pressure drop as cooling liquid exits the collar. In this embodiment, the notches may be eliminated. The aperture in the top member may be circular, as for aperture 126, or spiral, as for aperture 126'.

Without intending to limit the scope of the invention, the following example demonstrates the effectiveness of the cooling collar at maintaining even cooling of a neck of a cathode housing.

EXAMPLE

A computer simulation was conducted to generate a velocity distribution profile of a cooling collar of the design shown in FIG. 10 during operation of an x-ray tube of the type shown in FIG. 1. The inlet tube has an ID of 1.0 cm and the outlet tube an ID of 0.63 cm. The inlet flow rate is 3.12 m/s (4.0 grams/minute) and the outlet tube flow rate is 2.61 grams/minute. There are seventeen notches around the aperture. Each of the notches has a radius of 0.1 cm. The inlet fluid temperature is set at 40° C., which is approximately the same as the temperature of the outlet subflow.

Improved flow distribution and reduced stagnation are found with the present cooling system as compared with a cooling collar with a single outlet, diametrically opposite the inlet.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiment, the invention is now claimed to be:

1. A cooling device (70, 70', 70") for an associated x-ray tube (26) comprising:

a fluid inlet (72, 72', 72") which receives a supply of cooling fluid from an associated source (52);

a hollow cover member (110, 110', 110") in fluid communication with the inlet, the cover member:

including a wall (118, 118', 118") which defines an aperture (126, 126', 126") sized for receiving a portion (34) of the associated x-ray tube therethrough, defining, at least in part, an interior annular flow path (152, 152', 152") for cooling fluid to circulate around the portion (34) of the associated x-ray tube, and providing at least one fluid outlet (140, 140", 156, 156') through which cooling fluid exits the cover member at a plurality of locations around the portion of the associated x-ray tube.

2. The cooling device according to claim 1, wherein the flow path has a first end (150, 150') communicating with the fluid inlet and a second end (154, 154') located adjacent to the first end, such that the cooling fluid maintains a generally unidirectional flow.

3. The cooling device according to claim 2, wherein a baffle (144, 144') spaces the first end of the flow path from the second end of the flow path.

4. The cooling device according to claim 3, wherein the baffle (144, 144') is angled generally tangentially to a periphery of the portion (34) of the associated x-ray tube.

5. The cooling device according to claim 1, wherein the wall (118, 118', 118") defines a plurality of angularly spaced notches (140, 140") which extend radially outward from the aperture (126, 126") through which cooling fluid exits the cover member (70, 70").

6. The cooling device according to claim 5, wherein the notches (140, 140") have an angular spacing which decreases along the fluid flow path (152).

7. The cooling device according to claim 5, wherein the notches (140, 140") are more closely spaced at an end (154) of the fluid flow path furthest from the inlet than at an end (150) of the fluid flow path closest to the inlet (72, 72").

8. The cooling device according to claim 5, wherein there are at least eight notches.

9. The cooling device according to claim 1, wherein the aperture (126, 126', 126") is shaped to provide a gap (156, 156") between the portion (34) of the X ray tube and the wall (118, 118', 118") of the cover member.

10. The cooling device according to claim 9, wherein the gap (156') increases in width between a first end (150') of the flow path, adjacent the inlet tube, and a second end (154') of the flow path.

11. The cooling device according to claim 1, further including:

a fluid outlet (170), positioned between the fluid inlet (72") and the interior annular flow path (152") for directing a portion of the cooling fluid to contact another portion of the x-ray tube.

12. The cooling device according to claim 1, further including at least one mounting bracket (90, 90', 90", 92, 92', 92") for mounting the cooling device to a surface (32) of the associated x-ray tube.

13. The cooling device according to claim 1, wherein the cover member (110, 110', 110") defines a step (24) spaced from the wall which is shaped to support an electromagnetic coil (40) of the associated x-ray tube.

14. The cooling device according to claim 1, wherein the cover member (110, 110', 110") defines an opening (160) at an opposite end from the aperture for cooling fluid to contact an associated surface (32) of the x-ray tube adjacent the portion (34).

15. An x-ray tube assembly (1) comprising an x-ray tube (26) and the cooling device (70, 70', 70") according to claim 1.

16. The x-ray tube assembly according to claim 15 wherein:

the portion includes a neck (34) of a cathode housing (30) of the x-ray tube (26);

the cooling device is mounted to a plate (32) which is joined to the cathode housing neck, the plate forming a wall of an envelope (14) which defines an evacuated chamber (12) of the x-ray tube (26); and an anode (10) mounted within the evacuated chamber for rotation about an axis of rotation.

17. An x-ray tube assembly comprising:

a cathode housing (30) which supports a source of electrons (20), the cathode housing defining a neck (34);

a frame (14) defining an evacuated chamber (12), the frame being connected with the cathode housing neck;

an anode (10) positioned within the evacuated chamber to be struck by the electrons and generate x-rays; and a cooling device (70, 70', 70") according to claim 1 surrounding the neck of the cathode housing, the aperture (126, 126', 126") being sized for receiving the neck of the cathode housing therethrough, the interior annular flow path (152, 152') defined within the cover member circulating cooling fluid around the cathode housing neck, the aperture of the cover member providing at least one fluid outlet (140, 140", 156, 156') through which cooling fluid exits the cover member at a plurality of locations around the neck of the cathode housing.

18. The assembly of claim 17, wherein substantially all of the cooling fluid which enters the fluid flow path (152, 152') exits the cooling device through the aperture.

19. The assembly of claim 17, wherein the cooling device includes a base plate (86, 86', 86"), connected with the cover member at an opposite end to the aperture (126, 126', 126"), the base plate being mounted to the frame (14).

20. A method of cooling a neck (34) of an x-ray tube assembly (1) comprising:

mounting a cooling device (70, 70', 70") according to claim 1 around the neck;

supplying a cooling fluid to the cooling device, the cooling fluid flowing around the neck in an annular fluid flow path (152, 152") defined, at least in part, by the cooling device; and flowing the cooling fluid from the cooling device at a plurality of locations around the neck.

21. The method according to claim 20, further including:

directing the flow of cooling fluid such that the fluid flow in the flow path is unidirectional.

22. The method according to claim 20, wherein a volume of the flow of cooling fluid from the cooling device is substantially the same at an inlet end (150, 150') of the annular fluid flow path as at a terminal end (154, 154') of the annular flow path.

* * * * *